US010443789B2

(12) United States Patent
Minter et al.

(10) Patent No.: US 10,443,789 B2
(45) **Date of Patent: *Oct. 15, 2019**

(54) SAFETY ENDCAP ASSEMBLY FOR A LED TUBE

(71) Applicant: Silicon Hill B.V., Amsterdam (NL)

(72) Inventors: Charlie Minter, Amsterdam (NL); Tom Hilgerink, Amsterdam (NL); Martijn Jeroen Dekker, Groningen (NL); Jurgen Eduard Honold, Amsterdam (NL); Henk Emiel Cornelia Crone, The Hague (NL); Bregje Steenbeek, Rotterdam (NL)

(73) Assignee: Silicon Hill B.V., Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/835,537

(22) Filed: Dec. 8, 2017

(65) Prior Publication Data

US 2018/0100626 A1 Apr. 12, 2018

Related U.S. Application Data

(63) Continuation-in-part of application No. 15/035,500, filed as application No. PCT/NL2014/050735 on Oct. 21, 2014, now Pat. No. 10,060,603.

(30) Foreign Application Priority Data

Nov. 11, 2013 (NL) ..... 2011780

(51) Int. Cl.
*F21V 21/00* (2006.01)
*F21K 9/272* (2016.01)
(Continued)

(52) U.S. Cl.
CPC ..... *F21K 9/272* (2016.08); *F21K 9/278* (2016.08); *F21V 15/015* (2013.01);
(Continued)

(58) Field of Classification Search
CPC ... F21Y 2103/00; F21V 19/008; F21V 19/009
(Continued)

(56) References Cited

U.S. PATENT DOCUMENTS 8,330,362 B2 * 12/2012 Lin ..... F21V 3/02 313/512
8,456,319 B2 6/2013 Baker et al.
(Continued)

FOREIGN PATENT DOCUMENTS

DE 102010019875 A1 11/2011
DE 102015204716 9/2016
(Continued)

*Primary Examiner* — Daniel St Cyr
(74) *Attorney, Agent, or Firm* — Hoyng Rokh Monegier LLP; Ramin Amirsehhi

(57) ABSTRACT

A safety endcap assembly to be arranged at an end of an LED lamp. It has an endcap base element, an endcap cover element, a connector pin, a contact element for connecting to the connector pin to LEDs, and a switch button. The endcap cover element is moveable between a protracted position and a retracted position, and the switch button is moveable between a first position and a second position. The switch button is arranged to disconnect contact element from the LEDs when the switch button is in the first position. The safety endcap assembly further has a switch opening mechanism configured to move the switch button to the first position when a certain condition is met.

16 Claims, 9 Drawing Sheets

(51) Int. Cl.

| | |
|---|---|
| ***F21V 15/015*** | (2006.01) |
| ***F21V 23/06*** | (2006.01) |
| ***F21V 17/16*** | (2006.01) |
| ***F21K 9/278*** | (2016.01) |
| ***F21V 23/04*** | (2006.01) |
| ***F21V 25/04*** | (2006.01) |
| ***H01H 3/20*** | (2006.01) |
| ***H01R 13/447*** | (2006.01) |
| ***H01R 13/70*** | (2006.01) |
| ***H01R 33/08*** | (2006.01) |
| *F21Y 103/10* | (2016.01) |
| *F21Y 115/10* | (2016.01) |

(52) U.S. Cl.
CPC ..... *F21V 17/162* (2013.01); *F21V 23/04* (2013.01); *F21V 23/06* (2013.01); *F21V 25/04* (2013.01); *H01H 3/20* (2013.01); *H01R 13/447* (2013.01); *H01R 13/70* (2013.01); *H01R 33/0836* (2013.01); *F21Y 2103/10* (2016.08); *F21Y 2115/10* (2016.08)

(58) Field of Classification Search
USPC ..... 362/217.1, 217.11, 217.12, 217.14
See application file for complete search history.

(56) References Cited

U.S. PATENT DOCUMENTS

| | | | | |
|---|---|---|---|---|
| 8,579,463 | B2 * | 11/2013 | Clough | F21L 4/00 362/217.1 |
| 8,672,508 | B2 * | 3/2014 | Pearson | F21V 17/02 362/217.01 |
| 9,028,090 | B2 * | 5/2015 | Nagashima | H05B 33/0803 362/217.01 |
| 10,060,603 | B2 * | 8/2018 | Honold | F21V 25/04 |
| 2002/0008610 | A1 | 1/2002 | Peterson | |
| 2010/0171633 | A1 | 7/2010 | Baker et al. | |
| 2012/0043892 | A1 | 2/2012 | Visser et al. | |
| 2012/0106157 | A1 | 5/2012 | Simon et al. | |
| 2014/0003054 | A1 | 1/2014 | Simon et al. | |
| 2014/0009925 | A1 | 1/2014 | Verhoeven et al. | |

FOREIGN PATENT DOCUMENTS

| | | |
|---|---|---|
| EP | 3141814 | 3/2017 |
| GB | 2100400 | 12/1982 |
| JP | 2013008475 | 1/2013 |
| NL | 1039021 | 3/2013 |
| WO | WO 2012058556 | 5/2012 |
| WO | WO 2015 069101 | 5/2015 |
| WO | WO 2016119935 | 8/2016 |

* cited by examiner

SAFETY ENDCAP ASSEMBLY FOR A LED TUBE

CROSS REFERENCE TO RELATED APPLICATIONS

This application is a continuation-in-part of U.S. application Ser. No. 15/035,500, which corresponds to PCT application number PCT/NL2014/050735, which was filed on Oct. 21, 2014 and claims priority from Netherlands application number 2011780. These applications are hereby incorporated by reference in their entireties.

TECHNICAL FIELD

The present invention relates to a safety endcap assembly for use in a light emitting diode (LED) lamp arrangement, which is arranged to replace a fluorescent lamp in a luminaire.

BACKGROUND

Fluorescent lamps are widely used in a variety of locations, such as schools and office buildings. Although conventional fluorescent lamps have certain advantages, they also pose certain disadvantages, including disposal problems due to the presence of toxic materials within the tube. LED-based lamps, or LED tubes, which can be used as one-for-one replacements for fluorescent tube lamps, have emerged in recent years. Such LED-based replacement lamps typically include an elongate housing, with LEDs mounted on a circuit board inside the housing. An endcap is arranged at each longitudinal end of the housing for connecting the LED circuit board to the luminaire.

It has been observed that, after the use over a certain time period (e.g. a few months), a problem of overheating can occur in some of these LED lamps. Such overheating sometimes causes the LED lamp to melt, or even results in fire and burn hazards.

The inventors have identified that arcing is a cause of this problem. Arcing, or arc discharge, is an electrical breakdown of a gas that produces an ongoing electrical discharge. This occurs when two or more conductors in a circuit are not properly contacted. When there is a small gap between these conductors, the voltage across them could break down the gas resistance and create a current—as a small scale lightning. This current is typically high enough to increase the temperature of the components of the LED lamp, e.g. the circuit board of LEDs. This increase of temperature entails the risk of the melting of the LED lamp and the risk of fire and burn hazards.

Arcing is not assumed to occur in those lamps most LED lamps are carefully designed to avoid the presence of any small gap between conductors. According to the design of these lamps, all conductors are expected to be properly in contact with each other. Nevertheless, arcing still occurs after a certain time of use.

As recognized by the inventors, this unexpected behavior lies in an unexpected interaction between some safety mechanism in modern LED tubes and the fixture of the luminaire.

User safety is an important aspect when designing LED tubes. If the lamp fixture is energized when the LED tube is not yet completely installed into the fixture, and the user happens to grab the LED tube in a wrong position, electrical current can flow through the user's body and hurts the user. To avoid this risk, there are usually safety mechanisms in LED lamps which allow the connector pins and the circuit board of LEDs temporarily disconnected. Such mechanisms are typically designed in accordance with the standard size of the lamp fixture. However, a side-effect has been observed by the inventors that the safety mechanism can increase the pressure applied on the fixture of the luminaire. Due to this increased pressure, the distance between two ends of the fixture can increase over time. When the distance reaches a certain point, a gap can be created between the connector pins of the endcap and the LED circuit board, or between the connector pins and the connectors in the fixture. From there, arcing can occur.

SUMMARY OF THE INVENTION

It is therefore an object of the invention to reduce the risk of melting of an LED lamp and reduce the risk of fire and burn hazards caused by an LED lamp. More specifically, it is an object of the invention to reduce the risk of arcing in an LED lamp.

A first aspect of the invention concerns a safety endcap assembly according to claim 1.

The safety endcap assembly may be arranged at an end of an LED lamp having a plurality of LEDs. The safety endcap assembly may comprise:

- an endcap base element to be arranged at an end of a housing of the LED lamp;
- a connector pin extending along an axis;
- an endcap cover element moveable relative to the endcap base element along the axis, between a protracted position, in which the endcap cover element is more away from the endcap base element, and a retracted position, in which the endcap cover element is closer to the endcap base element;
- a contact element (which preferably extends along the same axis as the connector pin) for electrically connecting the connector pin to the LEDs; and
- a switch button moveable (e.g. rotatable) between a first position and a second position.

The switch button is a physical element which can be moved (e.g. by a user) to a certain position (e.g. the first position) to block the electrical connection between the contact element and the LEDs. The switch button preferably comprises a plate-like portion. The plate-like portion may have a circular shape (e.g. a disk-like shape) or any other shape, such as a rectangular, triangular, polygonal or irregular shape. The switch button may be made of an insulating material such as plastic. The movement of the switch button may include (but is not limited to) a rotation movement, a displacement movement, or a combination thereof.

In an embodiment, the switch button is arranged to disconnect the contact element from the LEDs when the switch button is in the first position. The switch button may be arranged in such a way that, as long as the switch button is in the first position, the contact element is disconnected from the LEDs. In this way, a safe user operation during installation can be achieved. As long as the switch button is in the first position, the user can trust that the lamp will not conduct electrical current. This feature also allows an arrangement of an arcing prevention mechanism, e.g. moving the switch button to the first position to disconnect the electrical connection when the risk of arcing increases.

The safety endcap assembly may further comprise:

- a first spring mechanism for urging the endcap cover element towards the protracted position; and
- a switch opening mechanism configured such that in case the switch button is in the second position, and the endcap cover element moves from the retracted position towards the protracted position over a predetermined distance, the switch button is moved to the first position.

The first spring mechanism comprises a spring which can be any type of elastic objects that store mechanical energy. Examples of the spring include a coil spring, rubber, a gas spring, etc. In this way, the mechanical energy stored in the spring can be used to move the endcap cover element relative to the endcap base element to urge the endcap cover element towards the protracted position.

The switch opening mechanism may use one or more of any mechanisms described in US 2016/0290606 A1, herewith incorporated by reference.

In this way, the first spring mechanism makes it possible to move the endcap cover element in accordance with the gradual shape change of the fixture, and once this movement reaches the predetermined distance, the switch opening mechanism can disconnect the contact element from the LEDs to reduce the risk of arcing.

Preferably, the switch opening mechanism is configured such that in case the switch button is in the second position, and the endcap cover element moves from the retracted position towards the protracted position over the predetermined distance, the switch button is switched to the first position within 0.5 second. This time period may be achieved, for example, using a spring biased against the switch button in the second position. The short time period makes it possible to reliably control the risk of arcing.

Preferably, the contact element is connected to the connector pin via a spring which defines a variable length. The variable length may include a first length, in which the spring is less compressed (e.g. when the spring in in an uncompressed natural state), and a second length, in which the spring is more compressed (e.g. when the endcap cover element is in the retracted position and the switch button is in the second position). Preferably, the first length, the second length and the predetermined distance are arranged to satisfy a following inequality:

$$D<A-B,$$

where D is the predetermined distance, A is the first length, and B is the second length.

Similarly to the first spring mechanism, the spring may be any type of elastic objects that store mechanical energy, such as a coil spring, rubber, a gas spring, etc.

In this way, as the predetermined distance (which triggers the switch opening mechanism) is smaller than the tolerance of the safety endcap assembly within which the contact element and the LEDs can still be reliably connected, the risk of arcing can be further reduced.

Preferably, the safety endcap assembly comprises two connector pins, two contact elements, and two springs. Each spring connects a connector pin to a respective contact element. This two-pin configuration is similar to conventional fluorescent lamps, thus allowing a simple manner for the user to install the LED lamp arrangement into the luminaire.

In an embodiment, the switch button comprises a hole, wherein, in the first position, the hole is not aligned with the contact element (and preferably also the connector pin) in the axis, and in the second position, the hole is aligned with the contact element (and preferably also the connector pin) in the axis. When the endcap cover element is in the retracted position and the switch button is in the second position, the contact element may extend through the hole of the switch button (e.g. to come into contact with an electrode which is connected to the LEDs.

In this way, since the hole is not aligned with the contact element in the first position of the switch button, the contact element can be physically blocked to prevent an electrical connection or a small gap with an electrode which connects to the LEDs, and can thus reliably reduce the risk of arcing by moving the switch button to the first position.

Preferably, the switch button comprises a first surface and a second surface, wherein the first surface and the second surface are substantially perpendicular to a direction in which the contact element extends (e.g. the axis of the connector pin). A distance between the first surface and the second surface is preferably at least 0.4 mm. This distance ensures that the risk of arcing is low when the contact element is blocked in the first position of the switch button.

In an embodiment, the switch button comprises a hole forming a third surface extending from the first surface or from the second surface (e.g. extending from the first surface to the second surface). The third surface preferably forms an angle less than 60 degrees with respect to the first surface or the second surface.

In this way, the third surface can form an edge which is sharp enough to cut into a contact between the contact element and an electrode connecting to the LEDs. This allows the switch button to force itself into the first position for disconnecting the contact element from the LEDs to reduce the risk of arcing.

In an embodiment, the switch opening mechanism comprises:

- a second spring mechanism for urging the switch button towards the first position;
- a switch arresting mechanism configured to arrest the switch button in the closed position when the endcap cover element is in the retracted position, and to release the switch button, in case the endcap cover element moves from the retracted position towards the protracted position over the predetermined distance.

The second spring mechanism may comprise a spring which may be any type of elastic objects that store mechanical energy. Examples of the spring include a coil spring, rubber, a gas spring, etc. in this way, the mechanical energy stored in the second spring mechanism can be used to force the switch button into the first position when the risk of arcing increases.

The switch opening mechanism may comprise an cantilevered beam or a torsion spring (e.g. in the second spring mechanism). In this way, the switch opening mechanism can be implemented in an simple and inexpensive manner.

The switch opening mechanism may comprise an elongated protrusion or recess (e.g. in the switch arresting mechanism) for arresting the switch button, wherein the protrusion or recess has a length substantially equal to the predetermined distance. This physical implementation of the predetermined distance can allow the switch opening mechanism to be triggered reliably.

In an embodiment, in the protracted position, the switch button is covered by the endcap cover element, and in the retracted position the switch button is exposed. This increases the user safety during the installation.

The safety endcap may further be configured such that the LEDs are only connected to the connector pin when the endcap cover element is in the retracted position and the switch button is in the second position. This mechanism adds another layer of security.

A second aspect of the invention concerns an LED lamp arrangement configured to be fit in a lamp fixture, the LED lamp arrangement comprising:

a housing;

a plurality of LEDs arranged in the housing;

a safety endcap assembly according to the first aspect of the invention; and an electrode (which may be an element of the safety endcap assembly) for electrically connecting the contact element to the LEDs.

In an embodiment, the switch button comprises a hole, wherein, when the endcap cover element is in the retracted position and the switch button is in the second position, the contact element extends through the hole of the switch button to come into contact with the electrode.

In an embodiment, the switch button comprises a first surface and a second surface, wherein the first surface and the second surface are substantially perpendicular to the axis, and wherein the contact between the contact element and the electrode is arranged in a space between the first surface and the second surface.

The switch button may comprise a hole forming a third surface extending from the first surface to the second surface, wherein the third surface forms an edge arranged to break the contact between contact element and the electrode.

The switch button may comprise a portion which forms a blade, and the contact between the contact element and the electrode and the blade defined by the switch button may be arranged in substantially the same cross-section.

These measures, alone or in combination, make it possible for the switch button to reliably cut into the contact between the contact element and the electrode when the switch opening mechanism moves the switch button from the second position to the first position. In this way, the switch button can reliably break the contact element and the electrode apart to disconnect the electrical connection and further reduce the risk of arcing.

In an embodiment, with the endcap cover element in its protracted position the LED tube assembly does not fit in the lamp fixture; and with the endcap cover element in its retracted position the LED tube assembly fits in the lamp fixture. This increases the user safety.

A third aspect of the invention comprises a method for operating an LED lamp arrangement comprising a safety endcap assembly according to the first aspect of the invention, in a luminaire, the method comprising:

moving the endcap cover element towards the protracted position in accordance with shape change of a fixture of the luminaire; and moving the switch button from the second position to the first position, in case the switch button is in the second position, and the endcap cover element moves from the retracted position towards the protracted position over a predetermined distance, the switch button is switched to the first position.

BRIEF DESCRIPTION OF THE DRAWINGS

The advantages of this invention will be apparent upon consideration of the following detailed disclosure of exemplary non-limiting embodiments of the invention, especially when taken in conjunction with the accompanying drawings wherein.

DETAILED DESCRIPTION OF PREFERRED EMBODIMENTS

Figure 1:
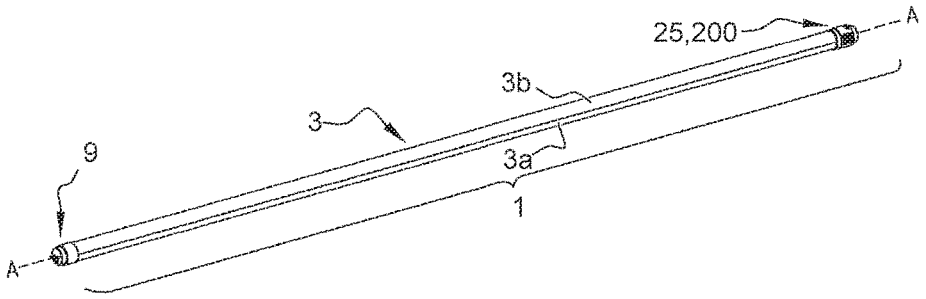
FIG. 1 shows an embodiment of the LED lamp 1 which comprises a safety endcap assembly according to the invention.

FIG. 1 shows an embodiment of the LED lamp arrangement 1 according to the invention. The LED lamp arrangement 1 comprises a housing 3, a plurality of LEDs arranged in the housing 3, a first endcap assembly 9 and a second endcap assembly 25. In the embodiment shown, the second endcap assembly 25 is a safety endcap assembly 200 according to the invention.

In the embodiment shown, the LED lamp 1 is an elongated tube, in which the housing 3 has an elongate shape. The LED lamp 1 may also have other shapes, such as a circular shape.

Figure 2A:
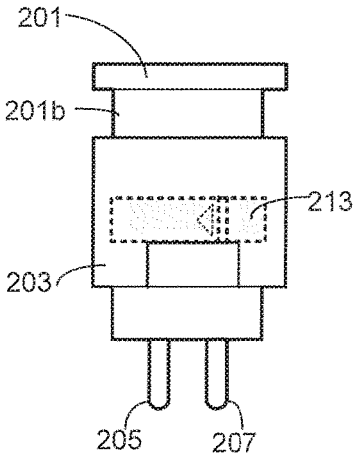
FIGS. 2A-2C show an embodiment of the safety endcap assembly according to the invention.
Figure 2B:
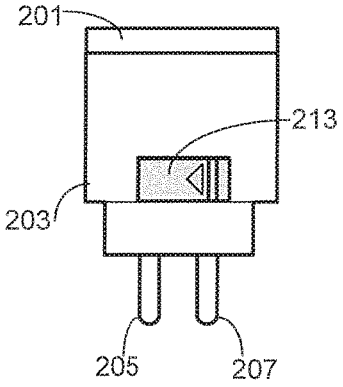
Figure 2C:
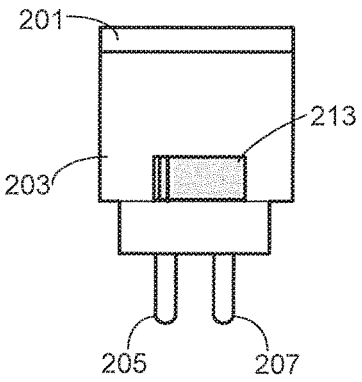

FIGS. 2A-2C show an embodiment of the safety endcap assembly 200 according to the invention. This embodiment may be used in the LED lamp arrangement 1 as shown in FIG. 1.

In the embodiment shown, the safety endcap assembly 200 comprises two connector pins 205, 207 a switch button 213, an endcap base element 201 to be arranged at an end of the housing 3 of the LED lamp 1, and an endcap cover element 203.

The endcap base element 201 and an endcap cover element 203 may be arranged to move relative to each other. In the embodiment shown, the endcap cover element 203 is arranged to slide along a circumferential wall 201*b* of the endcap base element 201. The relative movement between the endcap base element 201 and the endcap cover element 203 defines a protracted position (as shown in FIG. 2A), and a retracted position (as shown in FIGS. 2B and 2C). In the protracted position, the endcap cover element 203 is more away from the endcap base element 201; in the retracted position, the endcap cover element 203 is closer to the endcap base element 201.

The switch button 213 is moveable in two or more positions, including a first position and a second position. The movement may include (but is not limited to) a rotation movement. In the embodiment shown, the switch button 213 can be rotated from the first position (as shown in FIGS. 2A and 2B) to the second position (as shown in FIG. 2C). The relative movement between the endcap base element 201 and the endcap cover element 203, together with the movement (e.g. rotation) of the switch button 213, makes it possible to define at least 2×2=4 operation states. This degree of freedom can ensure the user safety during installation, and additionally allows a switch opening mechanism to be arranged to open the switch when the risk of arcing increases.

In a preferred embodiment, the safety endcap is configured such that the LEDs are only connected to the connector pins 205, 207 when both of the following conditions are met: (1) the endcap cover element 203 is in the retracted position, and (2) the switch button 213 is in the second position. The advantage of this arrangement is two-fold. First, this provides a double security to the user. As long as the switch button 213 is in the first position, the user can feel free to install the lamp without having to worry about the electrical shock. Second, a mechanism can be added to move the switch button 213 from the second position to the first position (thereby disconnecting the LEDs from the connector pins) when there is an increasing risk of arcing. In this way, the risk of arcing can be reduced.

Optionally, as shown in the dotted line in FIG. 2A, in the protracted position, the switch button 213 is hidden, for example covered by a circumferential wall of the endcap cover element 203. This way provides an additional layer of safety for the installation, because it reduces the risk that user accidentally rotates the switch button 213.

In embodiments shown above and below, the safety endcap assembly comprises two connector pins 205, 207. In this case, the LED lamp arrangement 1 has two pins on each side, i.e. four pins in total, just like a typical fluorescent lamp. In this way the user can install the LED lamp in a simple manner just like in the case of fluorescent lamps. Alternatively, the safety endcap assembly may have only one connector pin.

FIGS. 3A-3D shows an operation of a similar embodiment of the safety endcap assembly according to the invention. The safety endcap assembly in this embodiment may comprise one or more features of the embodiment in FIGS. 2A-2C.

Figure 3A:
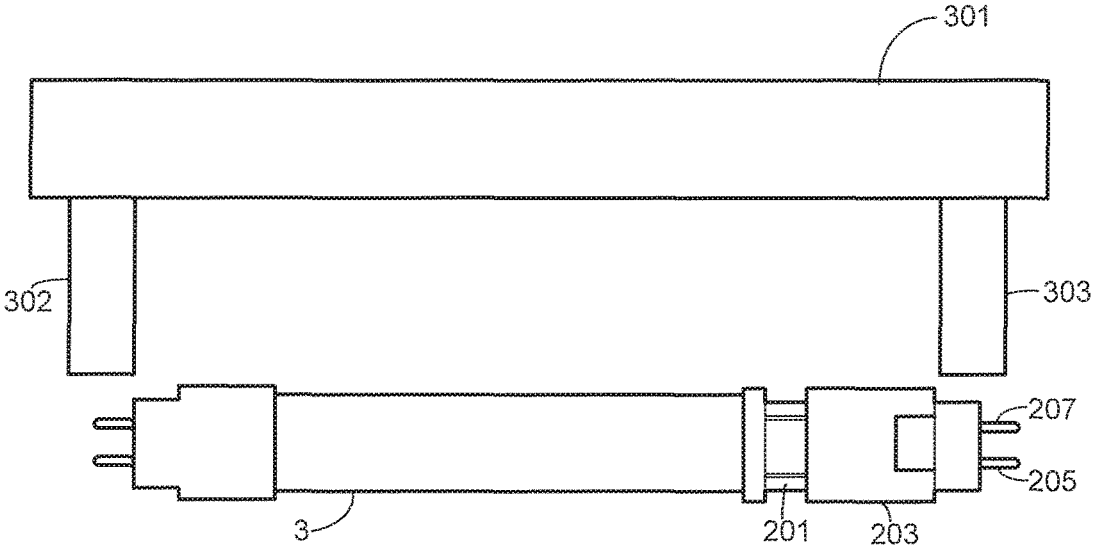
FIGS. 3A-3D shows an operation of an embodiment of the safety endcap according to the invention.

FIG. 3A shows a default state in this embodiment. The default state may be the state before the LED lamp is installed onto the fixture 302, 303 of the luminaire 301. In this embodiment, the default state corresponds to the state FIG. 2A, i.e. the endcap cover element 203 is in the protracted position, and the switch button 213 is in the first position. In this state, the LEDs are disconnected from the connector pins 205, 207.

Figure 3B:
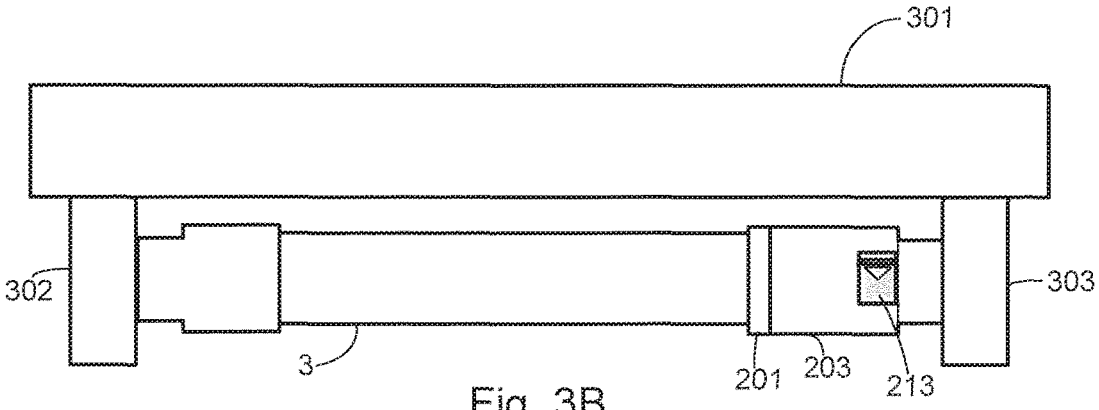

FIG. 3B shows a state in which the LED lamp is placed into the luminaire. In this embodiment, this states is similar to the state in FIG. 2B, i.e. the endcap cover element 203 is in the retracted position, and the switch button 213 is in a first position. In a preferred embodiment, as long as the switch button 213 remains in the first position (as the case in FIG. 3A and FIG. 3B), the LEDs remains disconnected during the installation. In this way, the user does not need to worry about the electrical shock when he puts the lamp into the fixture, which corresponds to the transition from FIGS. 3A to 3B.

Figure 3C:
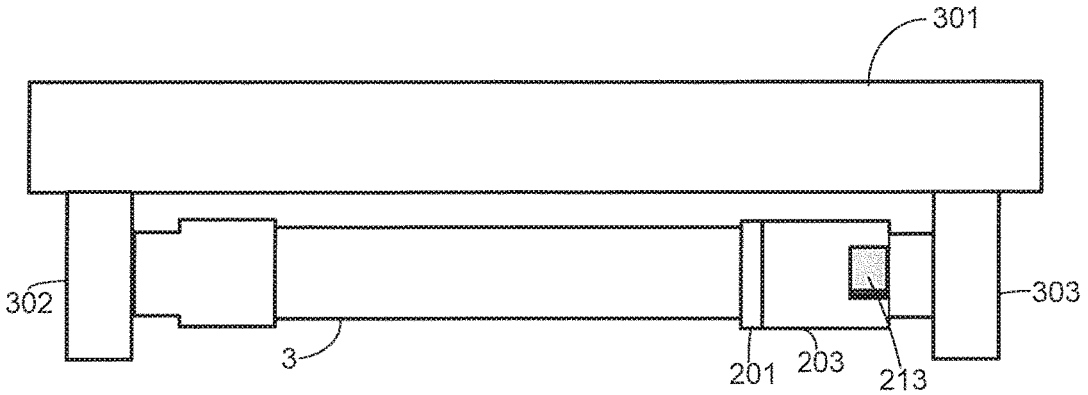

FIG. 3C shows a state in which the LEDs are ready to operate. In this embodiment, this state is similar to the state in FIG. 2C, i.e. the endcap cover element 203 is in the retracted position, and the switch button 213 is in a second position. In this state, the connector pins 205, 207 are connected to the LEDs for conducting the current.

Figure 3D:
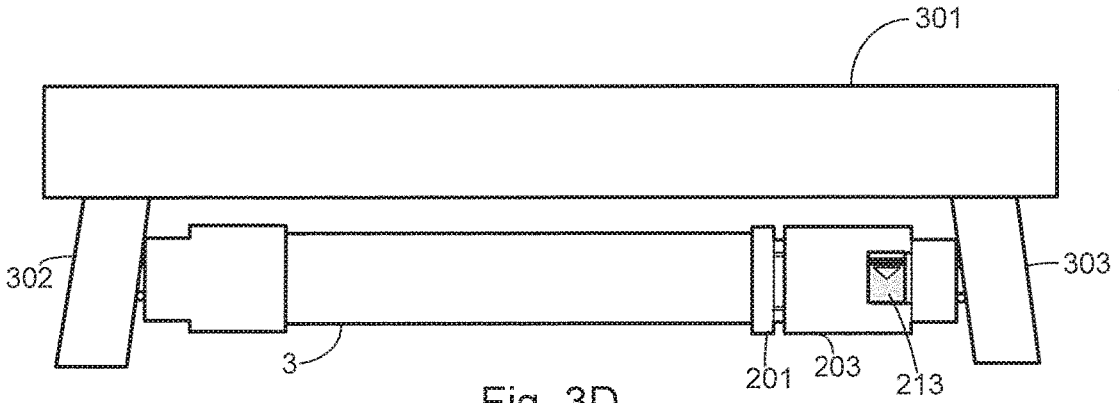

FIG. 3D shows a state after a certain time of use and a switch opening mechanism has been triggered to avoid arcing. The switch opening mechanism may use one or more of the same mechanisms as described in US 2016/0290606 A1, herewith incorporated by reference. As shown in the figure, the fixture 302, 303 of the luminaire no longer maintains its shape, e.g. due to a pressure applied on the fixture 302, 303, Accordingly, the endcap cover element 203 moves from the retracted position towards the protracted position over a certain distance. The safety endcap assembly according to the invention is designed such that, when this distance reaches a predetermined threshold, the switch button 213 automatically switches back to the first position, thereby disconnecting the LEDs. In this way, the LEDs can be disconnected before the deformation of the luminaire reaches the point at which arcing starts to occur.

Figure 4:
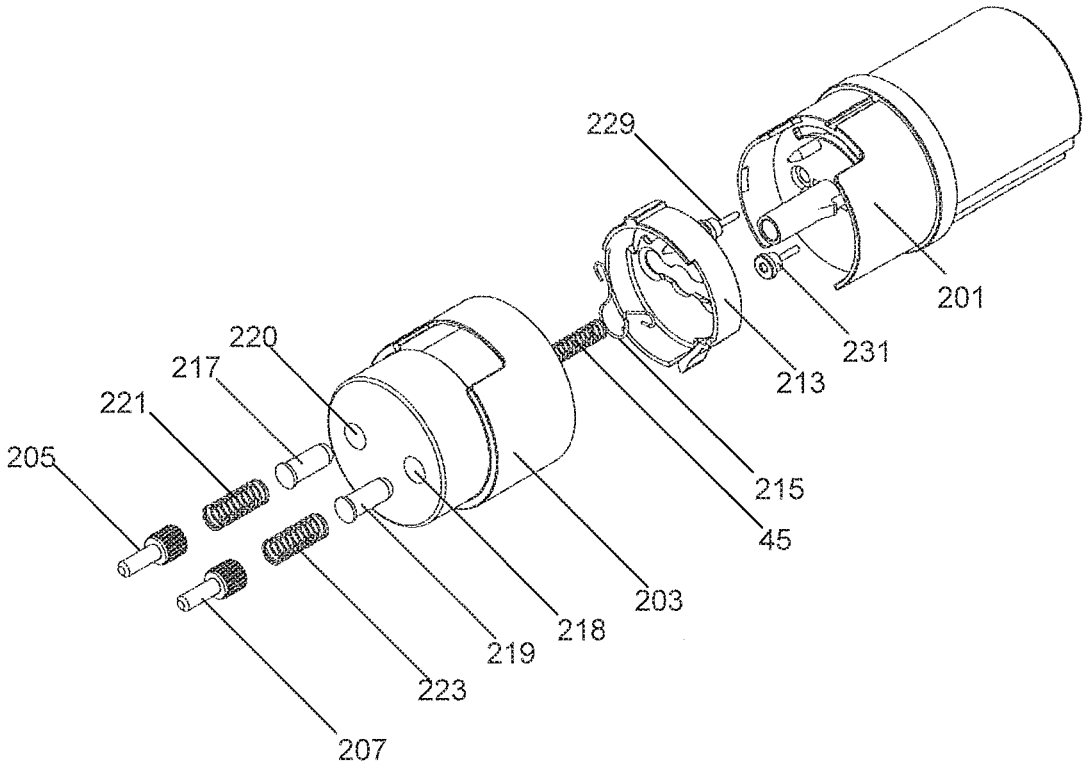
FIG. 4 shows another embodiment of the safety endcap assembly according to the invention.

FIG. 4 shows another embodiment of the safety endcap assembly 200 according to the invention. This embodiment may comprise one or more features as described above under FIGS. 1, 2A-2C, 3A-3D, and may further comprise some more details as will be described below.

In the embodiment shown in FIG. 4, each connector pin 205, 207 is connected to an electrically conductive connection spring 221, 223. Each spring 221, 223 is in turn connected to an electrically conductive contact element 217, 219. This makes it possible for the connector pin 205 to establish an electrical connection with the LEDs via the connection spring 221, 223 and the contact element 217, 219. The connection springs 221, 223 and the contact elements 217, 219 extend through holes 218, 220 in the endcap cover element 203 towards the switch button 213.

In this embodiment, the switch button 213 also comprises two holes. When the switch button is in the second position, the two holes are aligned with the contacting elements 218, 220. This allows the contacting elements 217, 219 to extends through the holes of the switch button 213 to come into contact with electrodes 229, 231, which are electrically connected to the LEDs.

In the embodiment shown, the safety endcap assembly 200 further comprises a spring 45 for pushing the endcap cover element 203 and a spring 215 for rotating the switch button 213. The spring 45 functions to urge the endcap cover element 203 towards the protracted position, and the spring 215 functions to urge the switch button 213 towards the first position. Spring 215 is activated when the endcap cover element 203 moves from the retracted position towards the protracted position over a predetermined distance. In this way, spring 45 gradually moves the endcap cover element 203 towards the protracted position as the fixture 302, 303 deforms, and when this movement reaches the predetermined distance, the spring 215 is activated and moves the switch button 213 to the first position, thereby disconnecting the LEDs from the connector pins 205, 207 to avoid arcing.

In the embodiment shown, the spring 45 is a coiled spring, and the spring 215 is a torsion spring. Other types of springs can also be used. For example, spring 215 may be implemented as a coil spring configured to generate a torque on the switch button 213. One or both of springs 45 and 215 may also be replaced by one or more of other components which perform similar functions. For example, grooves may be arranged on a side surface of the switch button 213 to rotate the switch button as the spring 45 pushes the endcap cover element 203.

In the embodiment shown, the electrodes 229, 231 are arranged in the safety endcap assembly. These electrodes may alternatively be arranged outside the safety endcap assembly, e.g. as a part of the LED circuit board in the LED lamp arrangement 1.

FIGS. 5A-5G show several states and a corresponding operation of an embodiment of the safety endcap assembly according to the invention. The safety endcap assembly in this embodiment may comprise one or more features as described under FIG. 4.

Figure 5A:
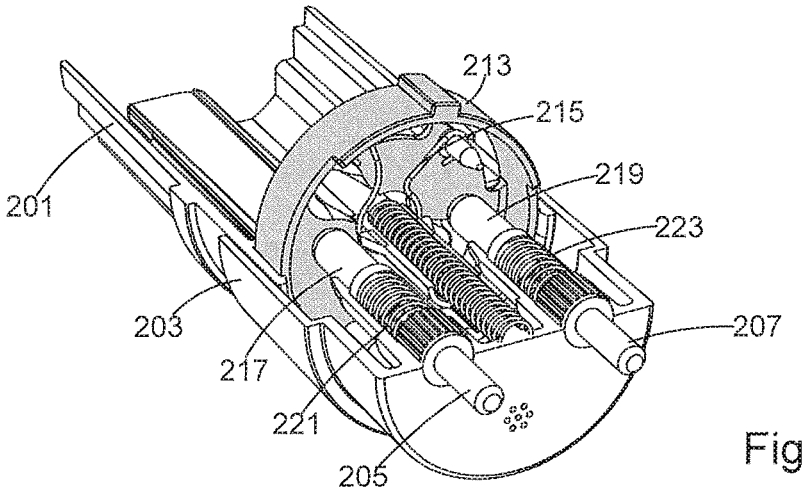
FIGS. 5A-5G show several states and a corresponding operation of a similar embodiment of the safety endcap assembly as FIG. 4.

FIG. 5A shows a state in which the endcap cover element 203 is in the protracted position and the switch button 213 is in the first position (similar to FIGS. 2A and 3A), In this state, the connection springs 221, 223 are not compressed, and the contact elements 217, 219 are not in contact with the front surface of the switch button 213.

Figure 5B:
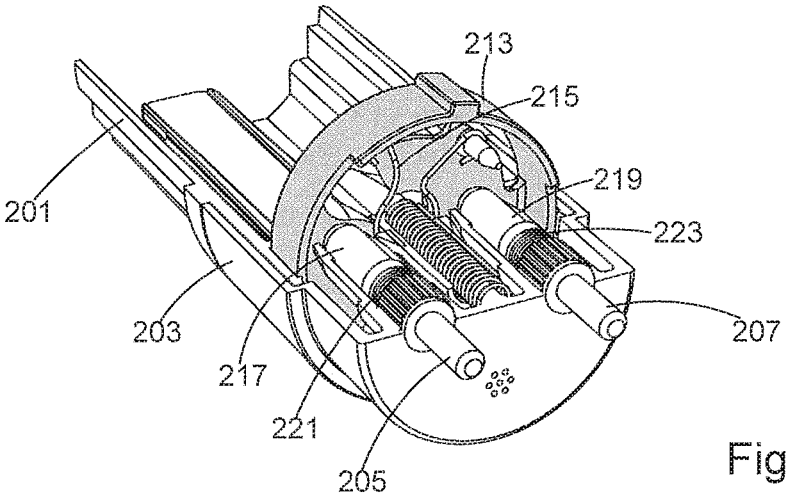

FIG. 5B shows a state in which endcap cover element 203 is in the retracted position and the switch button 213 in the first position (similar to FIGS. 2B and 3B). In this state, the connection springs 221 and 223 are compressed to push the contact elements 217, 219 against the front surface of the switch button 213, because the holes of the switch button 213 are not aligned with the contact elements 217.

Figure 5C:
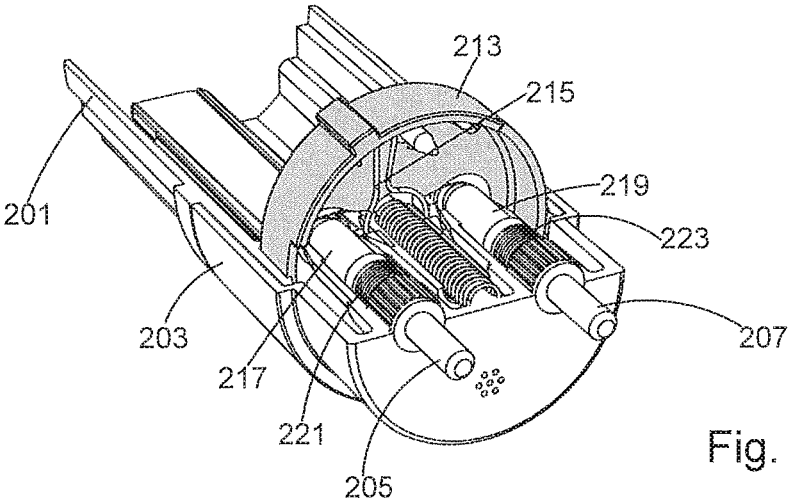

FIG. 5C shows a state in which the endcap cover element 203 is in the retracted position and the switch button 213 in the second position (similar to FIGS. 2C and 3C). In this position, the holes of the switch button 213 are aligned with the contact elements. The tips of the contact elements 217, 219 are thus pushed through the holes by the connection springs 221, 223, allowing the contact elements 217, 219 to come into contact with the electrodes 229, 231, thereby connecting to the LEDs.

Figure 5D:
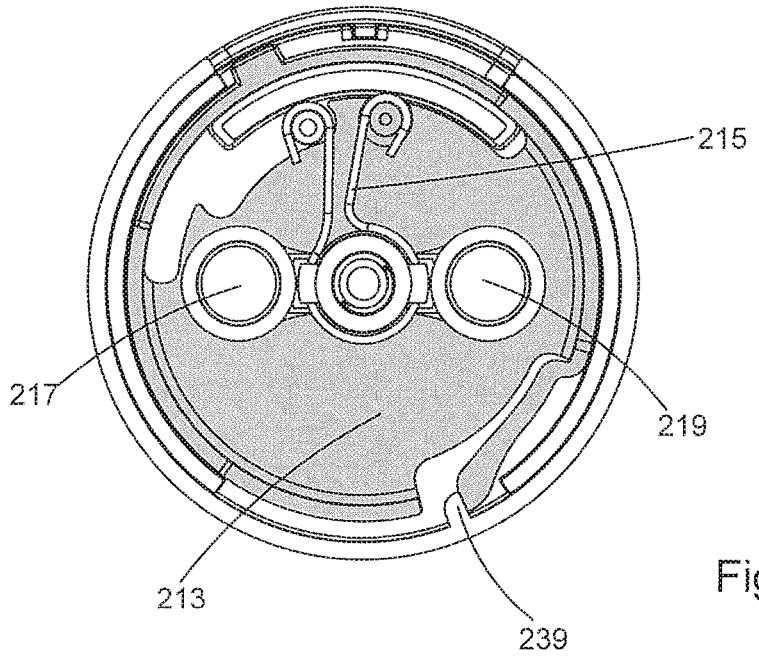

As shown in FIGS. 5C and 5D, in the second position of the switch button 213, the spring 215 is biased. In this state, the spring 215 carries an energy for forcing the switch button 213 into the first position. To maintain the switch button 213 in the second position when the LED lamp is installed, the safety endcap assembly 200 further comprises a switch arresting mechanism 239 that locks the switch button 213 in the second position.

Figure 5E:
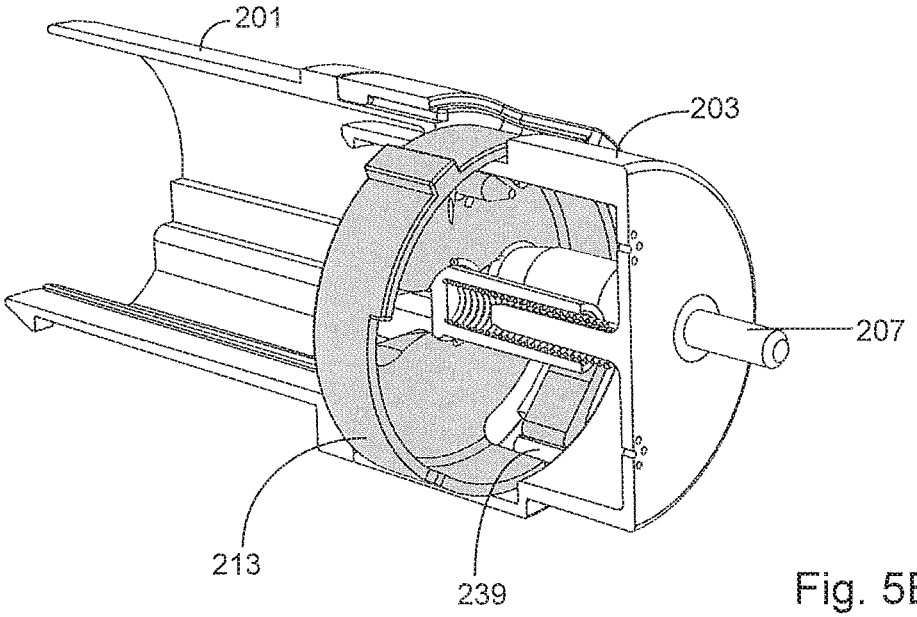

An example of the switch arresting mechanism 239 is a lock as shown in FIGS. 5D and 5E. In this embodiment, the lock comprises a protrusion arranged to engage with the switch button 213 when the endcap cover element 203 is in the retracted position. Alternatively, the lock may comprise a recess. The lock has a length substantially equal to the predetermined distance. This allows the switch arresting mechanism 239 to continue to arrest the switch button 213 as the endcap cover element 203 moves, until the movement reaches the predetermined distance.

Figure 5F:
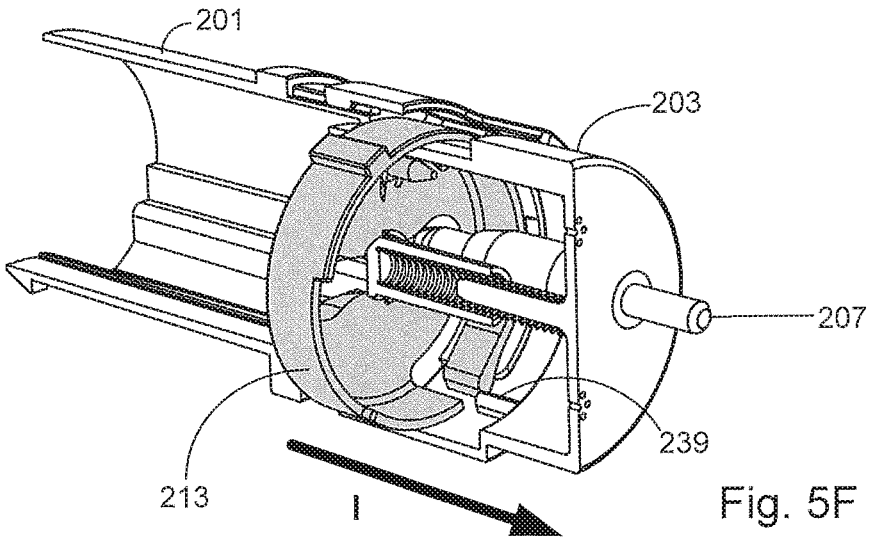

As shown in FIG. 5F, the spring 45 is arranged to assert a spring force between the endcap base element 201 and the endcap cover element 203. As the luminaire fixture changes its shape, the spring 45 pushes the endcap cover element 203 away from the endcap base element 201, as shown in Arrow I. In the embodiment shown, the mechanical lock 239 is arranged in the endcap cover element 203 and the switch 213 is arranged in the endcap base element 203.

Figure 5G:
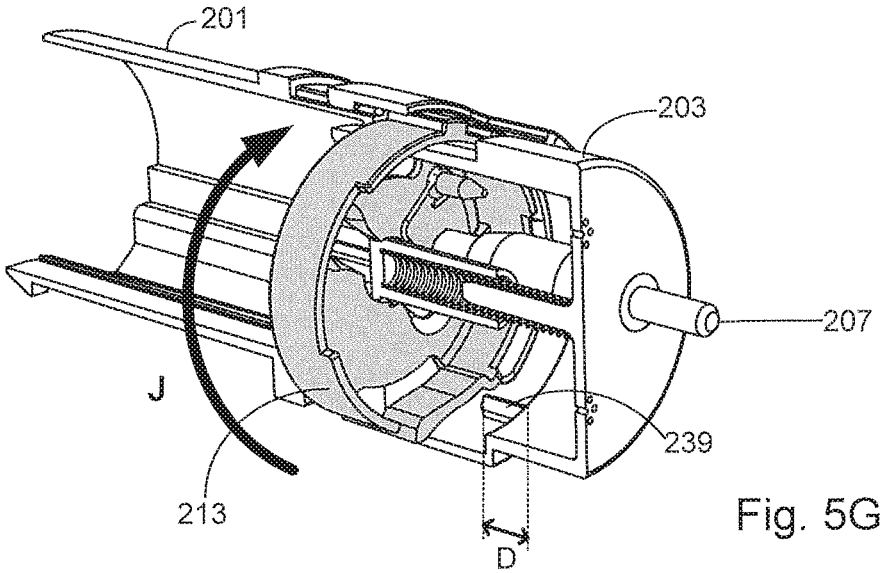

As shown in FIG. 5G, as the endcap cover element 203 moves over a predetermined distance D, the switch button 213 is no longer locked by the switch arresting mechanism 239. As a result, the spring 215 rotates the switch button 213 from the second position to the first position (as shown in Arrow J). In this embodiment, the spring force provided by spring 215 is arranged to overcome the spring force generated by the springs 221, 223, to allow the switch button 213 to break the contact between the electrodes 229, 231 and the contact elements 217, 219 so as to disconnect these elements.

Figure 6A:
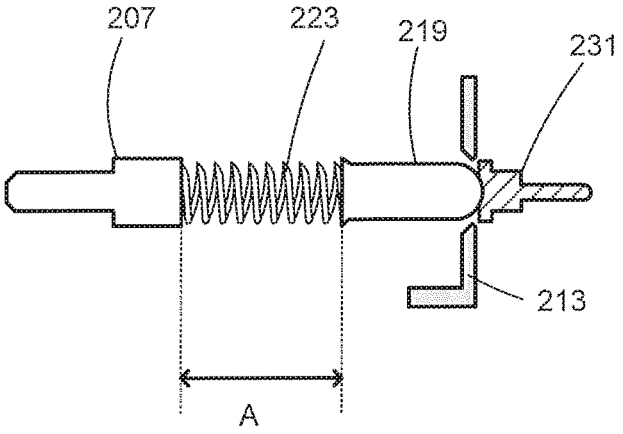
FIGS. 6A-6B schematically shows an embodiment of a spatial relationship between elements of a safety endcap assembly according to the invention.
Figure 6B:
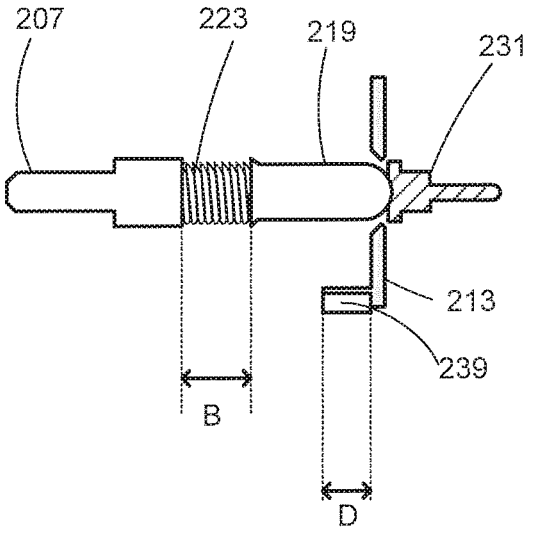

FIGS. 6A-6B show an embodiment of a safety endcap assembly which can tolerate the deformation of the fixture of a luminaire. The figures show a connector pin 207, a spring 223, a switch button 213, an electrode 231 and a switch arresting mechanism 239. These elements may have the same structure and/or function as in FIGS. 5A-5G. This embodiment may also comprise any other elements described above.

In this embodiment, spring 223 defines a variable length. Due to different degrees of the compression of the connection springs 221, 223, the distance between the connector pins 205, 207 and the contact elements 217, 219 can vary. In this way, as the endcap cover element 203 moves towards the protracted position (e.g. due to the deformation of the luminaire fixture), the contact elements 217, 219 can remain in contact with the electrodes 229, 231 to tolerate the deformation.

To avoid arcing, this tolerance is preferably larger than the predetermined distance (D), to ensure that the contact elements 217, 219 and the electrodes 229, 231 stay in contact until the switching opening mechanism is activated. In this embodiment, the variable length defined by the connection springs 221, 223 include a first length (A) (which may correspond to the natural state of the springs 221, 223 in the absence of an external force), as shown in FIG. 6A, and a second length (B) (which may correspond to the compression state of the springs 221, 223 when the endcap cover element 203 is in the retracted position and the switch button 213 is in the second position), as shown in FIG. 6B.

In this embodiment, the connection springs 221, 223 are configured such that the first length A, the second length B and the predetermined distance D (e.g. the length of the protrusion or recess in the switch opening mechanism 239) satisfy to the following inequality:

$$D<A-B.$$

In this way, as the predetermined distance D is less than the difference between the first length A and the second length B, at the point when the switch opening mechanism is activated, the contact element 217, 219 and the electrodes 229, 231 can remain in contact with each other. In this way, the switch button 213 can act to disconnect the contact element 217, 219 from the electrodes 229, 231 before arcing occurs.

Figure 7A:
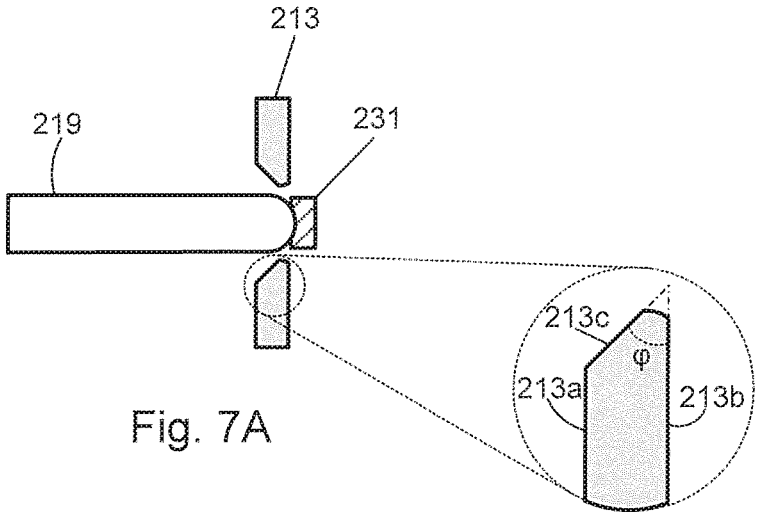
FIGS. 7A-7B show two embodiments of a contact element and a switch button in the safety endcap assembly according to the invention.
Figure 7B:
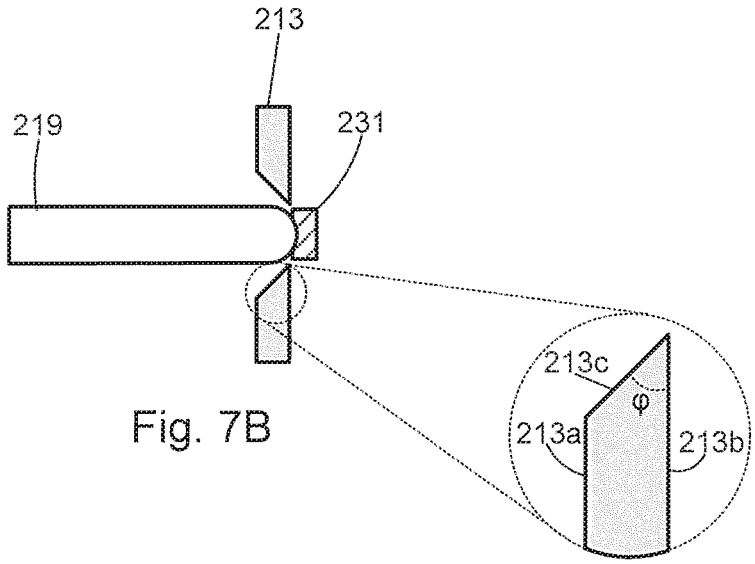

FIGS. 7A and 7B show two embodiments of the switch button 213, a contact element 219 and an electrode 231 according to the invention. These elements may be used in the safety endcap assembly as described above.

In the embodiments shown, the holes of the switch button 213 is arranged in substantially the same position in the longitudinal axis as the contact between the respective contact elements 217, 219 and electrodes 229, 231, to ensure that the switch button 213 can cut into the contact.

In both embodiments shown, the switch button 213 comprises a first surface 213*a*, a second surface 213*b*, and a third surface 213 which defines the hole of the switch button 213. The third surface 213 extends from the first surface 213*a* towards the second surface 213*b*. The third surface 213*c* forms an angle φ with respect to the first surface 213*a*. This angle φ is preferably less than 60 degrees.

Preferably, the third surface 213*c* and the first surface 213*a* or second surface 213*b* define a blade or an edge, as shown in FIG. 7B.

In this way, the blade or edge makes it easier for the switch button 213 to cut into the position, to ensure that the of the third surface 213*c* comes into contact with the tip of the contact element 217, 219, to assert a force to push back the contact elements 217, 219 in the direction hey extend. The decrease of the angle φ increases the force component in this direction, so smaller angle φ (e.g. less than 60 degrees) makes it easier for the switch button 213 to force itself between the contact elements 217, 219 and the electrodes 229, 231.

As shown in both FIGS. 7A and 7B, the tip of the contact elements 217, 219 are preferably dome shaped. In these embodiments, when the switch button 213 is moved towards the first position, the sloped portion will hit the dome shaped tip of the contact elements 217, 219 and assert a force in the direction of the connection springs 221, 223. The more towards the top of the dome, the easier the switch button 213 can push back the contact elements 217, 219.

While the principles of the invention have been set out above in connection with specific embodiments, it is to be understood that this description is merely made by way of example and not as a limitation of the scope of protection, which is determined by the appended claims,

The invention claimed is:

1. A safety endcap assembly to be arranged at an end of an LED lamp having a plurality of LEDs, the safety endcap assembly comprising:

an endcap base element to be arranged at an end of a housing of the LED lamp;

a connector pin extending along an axis;

an endcap cover element moveable relative to the endcap base element along the axis, between a protracted position, in which the endcap cover element is more away from the endcap base element, and a retracted position, in which the endcap cover element is closer to the endcap base element;

a contact element for electrically connecting the connector pin to the LEDs;

a switch button movable between a first position and a second position, wherein the switch button is arranged to disconnect contact element from the LEDs when the switch button is in the first position, and wherein the safety endcap assembly further comprises:

a first spring mechanism for urging the endcap cover element towards the protracted position; and a switch opening mechanism configured such that in case the switch button is in the second position, and the endcap cover element moves from the retracted position towards the protracted position over a predetermined distance, the switch button is moved to the first position.

2. The safety endcap assembly according to claim 1, wherein the contact element is connected to the connector pin via a spring, wherein the spring defines a variable length, including a first length, in which the spring is less compressed, and a second length, in which the spring is more compressed, wherein the first length, the second length and the predetermined distance are arranged to satisfy a following inequality:

$$D<A-B,$$

where D is the predetermined distance, A is the first length, and B is the second length.

3. The safety endcap assembly according to claim 1, wherein the switch button comprises a hole, wherein, in the first position, the hole is not aligned with the contact element in the axis, and in the second position, the hole is aligned with the contact element in the axis, wherein, when the endcap cover element is in the retracted position and the switch button is in the second position, the contact element extends through the hole of the switch button.

4. The safety endcap assembly according to claim 1, wherein the switch button comprises a first surface and a second surface, wherein the first surface and the second surface are substantially perpendicular to the axis, and wherein a distance between the first surface and the second surface is at least 0.4 mm.

5. The safety endcap assembly according to claim 4, wherein the switch button comprises a hole forming a third surface extending from the first surface to the second surface, wherein the third surface forms an angle less than 60 degrees with respect to the first surface or the second surface.

6. The safety endcap assembly according to claim 1, wherein the switch opening mechanism comprises:

a second spring mechanism for urging the switch button towards the first position;

a switch arresting mechanism configured to arrest the switch button in the closed position when the endcap cover element is in the retracted position, and to release the switch button, in case the endcap cover element moves from the retracted position towards the protracted position over the predetermined distance.

7. The safety endcap assembly according to claim 1, wherein the switch opening mechanism comprises an cantilevered beam or a torsion spring.

8. The safety endcap assembly according to claim 1, wherein the switch opening mechanism comprises an elongated protrusion or recess for arresting the switch button, wherein the protrusion or recess has a length substantially equal to the predetermined distance.

9. The safety endcap assembly according to claim 1, wherein the safety endcap is configured such that the LEDs are only connected to the connector pin when the endcap cover element is in the retracted position and the switch button is in the second position.

10. The safety endcap assembly according to claim 1, wherein, in the protracted position, the switch button is covered by the endcap cover element, and in the retracted position, the switch button is exposed.

11. An LED lamp arrangement configured to be fit in a fixture of a luminaire, the LED lamp arrangement comprising:

a housing;

a plurality of LEDs arranged in the housing;

a safety endcap assembly on at least one end of the housing; and an electrode for electrically connecting the contact element to the LEDs;

wherein the safety endcap assembly comprises:

an endcap base element to be arranged at an end of a housing of the LED lamp;

a connector pin extending along an axis;

an endcap cover element moveable relative to the endcap base element along the axis, between a protracted position, in which the endcap cover element is more away from the endcap base element, and a retracted position, in which the endcap cover element is closer to the endcap base element;

a contact element for electrically connecting the connector pin to the LEDs;

a switch button movable between a first position and a second position, wherein the switch button is arranged to disconnect contact element from the LEDs when the switch button is in the first position, and wherein the safety endcap assembly further comprises:

a first spring mechanism for urging the endcap cover element towards the protracted position; and a switch opening mechanism configured such that in case the switch button is in the second position, and the endcap cover element moves from the retracted position towards the protracted position over a predetermined distance, the switch button is moved to the first position.

12. The LED lamp arrangement according to claim 11, wherein the switch button comprises a hole, wherein, when the endcap cover element is in the retracted position and the switch button is in the second position, the contact element extends through the hole of the switch button to come into contact with the electrode.

13. The LED lamp arrangement according to claim 11, wherein the switch button comprises a first surface and a second surface, wherein the first surface and the second surface are substantially perpendicular to the axis, and wherein the contact between the contact element and the electrode is arranged in a space between the first surface and the second surface.

14. The LED lamp arrangement according to claim 13, wherein the switch button comprises a hole forming a third surface extending from the first surface to the second surface, wherein the third surface forms an edge arranged to break the contact between contact element and the electrode.

15. The LED lamp arrangement according to claim 11, wherein with the endcap cover element in its protracted position the LED tube assembly does not fit in the lamp fixture; and with the endcap cover element in its retracted position the LED tube assembly fits in the lamp fixture.

16. A method for operating an LED lamp arrangement in a luminaire, the LED lamp arrangement comprising a safety endcap assembly, wherein the safety endcap assembly comprises:

an endcap base element to be arranged at an end of a housing of the LED lamp;

a connector pin extending along an axis;

an endcap cover element moveable relative to the endcap base element along the axis, between a protracted position, in which the endcap cover element is more away from the endcap base element, and a retracted position, in which the endcap cover element is closer to the endcap base element;

a contact element for electrically connecting the connector pin to the LEDs;

a switch button movable between a first position and a second position, wherein the switch button is arranged to disconnect contact element from the LEDs when the switch button is in the first position, and wherein the safety endcap assembly further comprises:

a first spring mechanism for urging the endcap cover element towards the protracted position; and a switch opening mechanism configured such that in case the switch button is in the second position, and the endcap cover element moves from the retracted position towards the protracted position over a predetermined distance, the switch button is moved to the first position, the method comprising:

moving the endcap cover element towards the protracted position in accordance with shape change of a fixture of the luminaire; and moving the switch button from the second position to the first position, in case the switch button is in the second position, and the endcap cover element moves from the retracted position towards the protracted position over a predetermined distance, the switch button is switched to the first position.

* * * * *